US005420770A

United States Patent [19]

Goldman

[11] Patent Number: 5,420,770

[45] Date of Patent: May 30, 1995

[54] LIGHTING FIXTURE

[76] Inventor: Neil M. Goldman, 339 South Quince St., Philadelphia, Pa. 19107

[21] Appl. No.: 199,050

[22] Filed: Feb. 22, 1994

[51] Int. Cl.[6] ..... F21V 7/12

[52] U.S. Cl. ..... 362/297; 362/298; 362/346

[58] Field of Search ..... 362/235, 297, 298, 346, 362/362

[56] References Cited

U.S. PATENT DOCUMENTS

| | | | |
|---|---|---|---|
| 4,112,483 | 9/1978 | Small Jr. et al. | 362/298 |
| 5,134,558 | 7/1992 | Williams et al. | 362/298 |
| 5,180,222 | 1/1993 | Robinson | 362/298 |
| 5,199,786 | 4/1993 | Baldzian | 362/298 |

*Primary Examiner*—Richard R. Cole
*Attorney, Agent, or Firm*—Stuart E. Beck

[57] ABSTRACT

A lighting fixture that has two light sources and a reflector that reflects each light source up to seven times to provide high efficiency and uniform illumination. At some angles some of the reflections are blocked by the two light sources so that depending on the angle, more or less light sources are available for illumination. A method of providing efficient and uniform illumination. The method comprises providing two light sources and then reflecting each of them in two steps to create a total of sixteen light sources. At some angles some of the reflections are blocked by the two light sources so that depending on the angle, more or less light sources are available for illumination.

9 Claims, 2 Drawing Sheets

LIGHTING FIXTURE

FIELD OF THE INVENTION

This invention relates to lighting fixtures, and more particularly to a highly efficient reflector for a lighting fixture which provides a relatively uniform amount of light over a large area.

BACKGROUND OF THE INVENTION

Conventional lighting fixtures are highly inefficient. Thus, notwithstanding the fact that they include reflectors, a substantial portion of the light given off by the bulb or other light source is internally absorbed by the lighting fixture so that a relatively low amount of light is directed in the direction to be illuminated.

Further, these lighting fixtures also tend to create an uneven level of light over the area that is illuminated. Thus, the light is brightest directly under the fixture and is less bright only slightly to the side of the fixture.

It would be desirable to have a lighting fixture which has an efficient reflector and which provides a relatively uniform amount of light over the area illuminated by the fixture.

With the foregoing in mind, the invention relates generally to a lighting fixture comprising a reflector. The reflector has the shape of a generally elongated trough with a plurality of interior end walls and side walls that have interior reflective surfaces. The end walls are arranged so that they diverge in the direction which is to be illuminated. Each of the reflectors comprising the side walls includes first and second sections that are arranged so that they converge in the direction that is to be illuminated. Each of the end walls includes means for receiving a light source.

The invention also relates to a method of providing efficient and uniform illumination. The method comprises the steps of providing at least one light source and then reflecting it in two steps to create a total of eight light sources. At some angles some of the reflections are blocked by the light source so that depending on the angle, more or less light sources are available for illumination.

DESCRIPTION OF A PREFERRED EMBODIMENT

Figure 1:
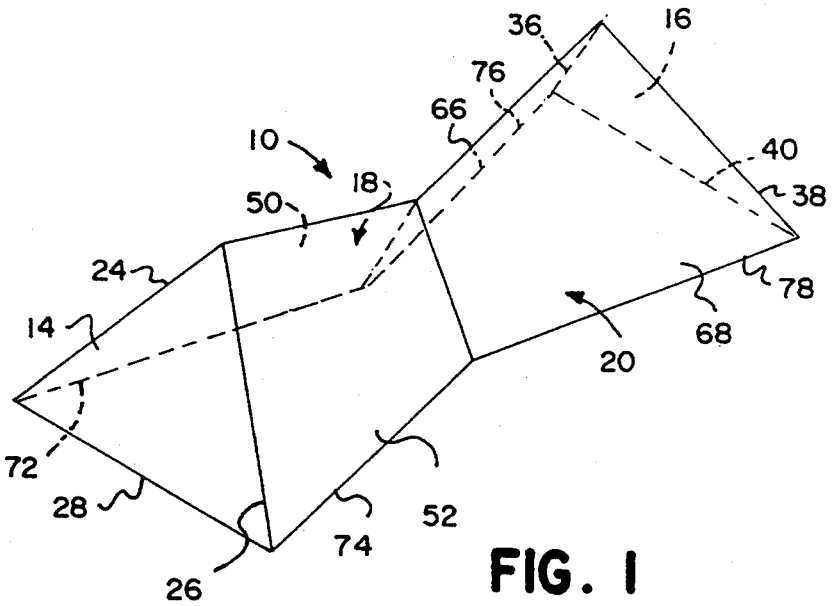
FIG. 1 is a top perspective view of a lighting fixture constructed in accordance with a presently preferred form of the invention.

Referring now to FIG. 1 a lighting fixture 10 constructed in accordance with a presently preferred form of the invention is illustrated.

The lighting fixture 10 is generally trough shaped. It includes end walls 14 and 16 and side walls 18 and 20; the inner facing surfaces of which are comprised of reflective material such as mirror, highly polished metal or the like.

Each of the end walls 14 and 16 is flat. They are arranged so that they diverge in the direction that is to be illuminated.

Figure 4:
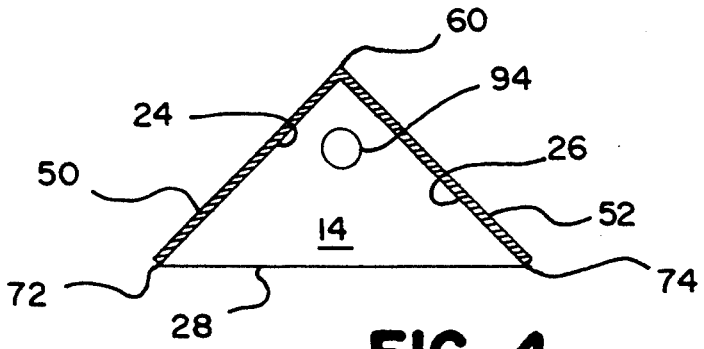
FIG. 4 is a section view taken along line 4—4 of FIG. 3.

As seen in FIG. 4 end wall 14 comprises an isosceles right triangle with edges 24 and 26 being disposed at a generally right angle to each other and edge 28 comprising the base of the triangle.

Figure 5:
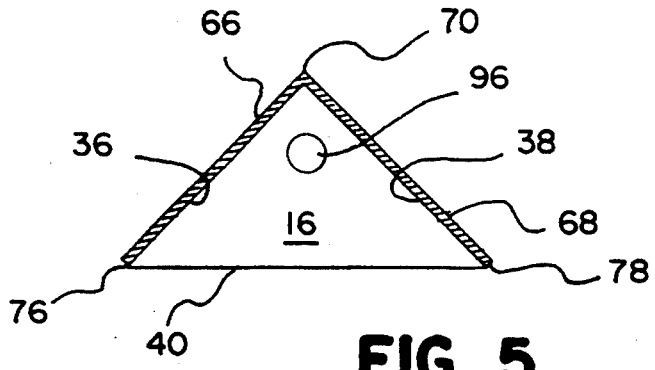
FIG. 5 is a section view taken along line 5—5 of FIG. 3.

As seen in FIG. 5, end wall 16 also comprises an isosceles right triangle with edges 36 and 38 being disposed at a generally right angle to each other and edge 40 comprising the base of the triangle.

Side wall 18 is connected between edge 24 of end wall 14 and edge 36 of end wall 16. Side wall 20 is connected between edge 26 of end wall 14 and edge 38 of end wall 16. Each of the side walls 18 and 20 comprises two flat portions, 50 and 66, and 52 and 68 respectively.

The flat side wall portions 50 and 52 are connected at a substantially right angle to end wall 14 at edges 24 and 26, and are connected to each other at a substantially right angle at a vertex 60 that is in alignment with the juncture of edges 24 and 26.

The flat side wall portions 66 and 68 are connected at a substantially right angle to end wall 16 at edges 36 and 38, and are connected to each other at a substantially right angle at a vertex 70 that is in alignment with the juncture of edges 36 and 38.

Side wall portions 50 and 66 are connected to each other along their opposite edges 80 while side portions 52 and 68 are connected to each other along their opposite edges 82.

Edges 80 and 82 define a transverse plane 86 for the lighting fixture while vertices 60 and 70 define its longitudinal plane 88. The lighting fixture 10 is symmetrical along both the transverse plane 86 and the longitudinal plane 88.

Figure 3:
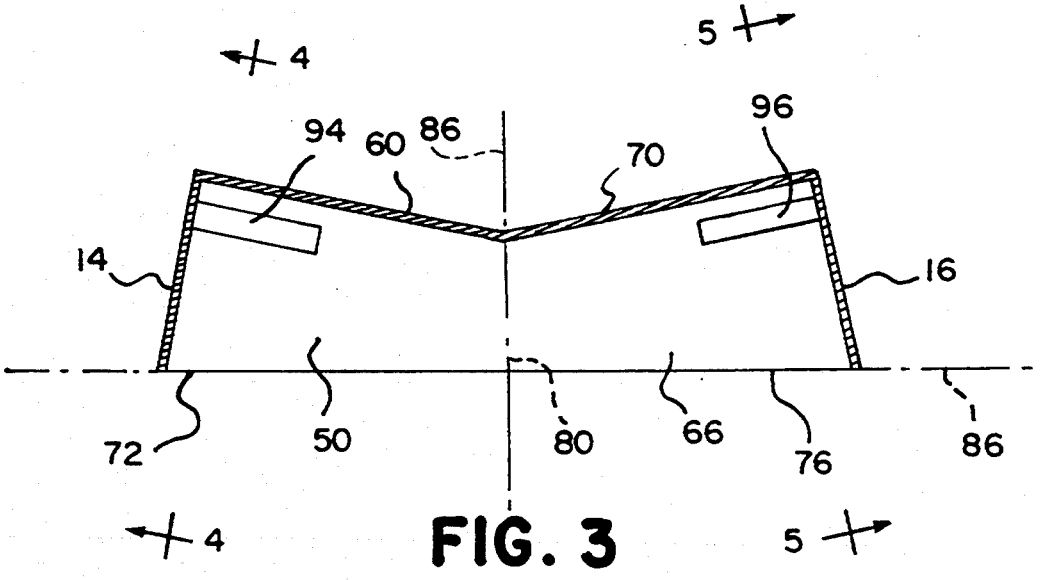
FIG. 3 is a section view taken along line 3—3 of FIG. 2.

Each of the side wall portions 50, 52, 66 and 68 include a bottom edge 72, 74, 76 and 78 respectively. As best seen in FIG. 3, bottom edges 72, 74, 76 and 78 are in the same plane. This enables the fixture 10 to lie flush with a room ceiling 86.

Figure 2:
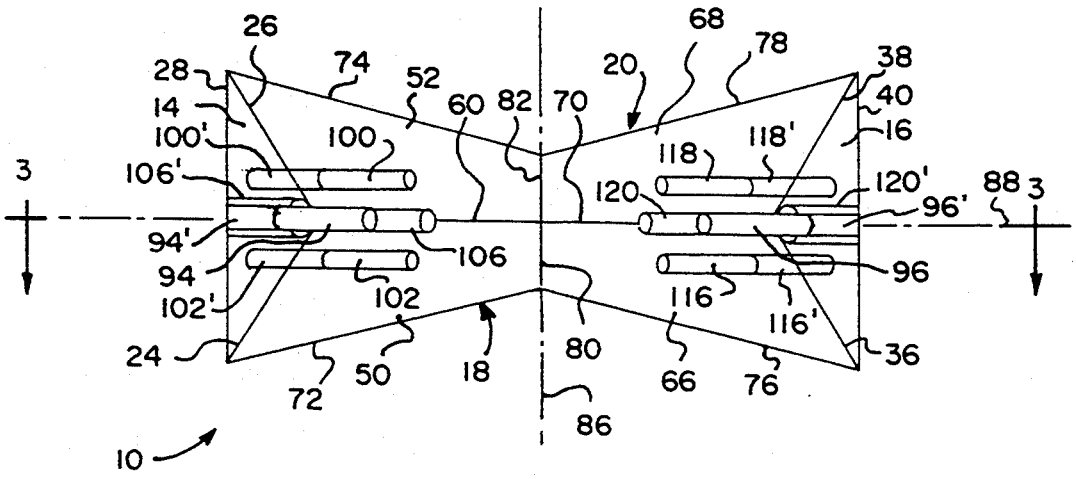
FIG. 2 is a bottom view of the interior of the presently preferred embodiment of the invention that illustrates the arrangement of the reflector surfaces.

When the fixture is seen in FIGS. 1 and 2, the side walls 18 and 20 are generally "V" shaped. This is because each of the side walls is comprised of two sections 50 and 52 or 56 and 68 which themselves are disposed at right angles to each other and their respective end walls 14 and 16.

Further, as seen in FIGS. 1 and 3 vertices 60 and 70 define a "V" that lies along the longitudinal plane 88.

Each of the end walls 14 and 16 includes a suitable receptacle (not shown) in which a bulb 94, 96 is received. As best seen in FIG. 3 the bulbs 94 and 96 are spaced from the vertices 60 and 70 a distance that is equal to about the width of the bulb and lie along longitudinal plane 88.

As best seen in FIG. 2, because of the arrangement of the side walls and end walls, bulbs 94 and 96 each appear to create seven reflected images to provide eight light sources on each side of the transverse plane 86. Accordingly the two light sources 94 and 96 have become sixteen light sources.

Thus, bulb 94 creates reflected image 100 in side portion 52, reflected image 102 in side portion 50 and reflected image 106 which appears in both side portions 50 and 52 across vertex 60. Those three reflected images, namely, 100,102 and 106 along with the actual bulb 94 are again reflected in end wall 14 as images 94', 100', 102' and 106' (shown slightly oversize to be visible behind image 94).

Similarly, bulb 96 creates reflected image 116 in side portion 66, reflected image 118 in side portion 68 and reflected image 120 which appears in both side portions 66 and 68 across vertex 70. Those three reflected images, namely, 116, 118 and 120 along with the actual bulb 96 are again reflected in end wall 16 as images 96', 116', 118' and 120' (shown slightly oversize to be visible behind image 120).

The amount of light reflected to either side of the longitudinal plane 88 of the fixture 10 is somewhat greater than that reflected directly below it. This is because the bulbs 94 and 96 block the light from their reflected images 106 and 120 along the plane. However, the light from images 106 and 120 can illuminate those areas on either side of the longitudinal plane 88 because the bulbs 94 and 96 are spaced from their respective vertices as described earlier. Thus, if the bulbs 94 and 96 were adjacent to their respective vertices, not only would they block the light from their reflected images 106 and 120, but they would also partially block the light from images 100 and 102 and images 116 and 118. Accordingly, because the bulbs 94 and 96 are spaced from their respective vertices, the light output from the lighting fixture 10 is evenly distributed.

If a lighting fixture 10 constructed in accordance with the invention is mounted in an eight foot ceiling, which is typical for new construction, the fixture will put out an area of even light over a radius of about seven feet, after which it falls off slightly.

Thus, by using the lighting fixture described herein, a substantial amount of light can be extracted from the bulb by minimizing the internal absorption. This is accomplished by positioning the light bulb so that almost all of the light that it radiates is reflected.

While the invention has been described with reference to one embodiment, it is apparent in other forms will be obvious to those skilled in the art. Thus, the scope of the invention should not be limited by this description, but, rather, only by the scope of the appended claims.

I claim:

1. A lighting fixture comprising a reflector, said reflector having a generally elongated, trough shape that includes a plurality of end walls and side walls that have interior reflective surfaces and which are symmetrical about a transverse plane and symmetrical about a longitudinal plane that is disposed at a right angle to said transverse plane, means in each of said end walls for receiving a light source, said end walls diverging in a direction of illumination, each of said side walls being connected to said end walls, and being generally "V" shaped, and said side walls diverge in the direction of illumination so that when a light source is in each of said means for receiving a light source the light from each of said light sources is reflected seven times in the interior reflective surfaces of its adjacent side walls and end wall.

2. A lighting fixture as defined in claim 1 wherein each of said side walls include first and second portions that are symmetrical about said transverse plane, one edge of each of said portions being connected to one of said end walls, an opposite edge of each of said portion being connected to a corresponding opposite edge of said other portion along said transverse plane, and said portions of each of said side walls converge in a direction toward said transverse plane so that they reflect light away from each other.

3. A lighting fixture as defined in claim 1 wherein each of said end walls and its adjacent side walls are disposed at substantially mutual right angles to each other.

4. A lighting fixture as defined in claim 3 wherein said adjacent side walls are connected to each other at a vertex, and said means for receiving a light source is spaced from said vertex a distance which is about a width of the light source.

5. A lighting fixture as defined in claim 1 wherein each of said side walls includes a bottom edge, and said bottom edges lie in a common plane so that said lighting fixture can lie flush in a ceiling.

6. A lighting fixture as defined in claim 1 wherein said means for receiving said light source is disposed on said longitudinal plane.

7. A method of providing uniform illumination comprising the steps of providing a longitudinal plane, providing first light source, creating three reflected images of said first light source so that said first light source and said reflected images provide four second light sources with one of said reflected images lying along said longitudinal plane, creating a reflected image of said second light sources so that a total of eight light sources are created, and directing said total of eight light sources in a direction of illumination.

8. A method as defined in claim 7 including the step of locating said first light source on said longitudinal plane so that it blocks one of said reflected images of said second four light sources in said longitudinal plane.

9. A method as defined in claim 8 wherein said first light source having a width and being spaced from said reflected images of said second light sources by a distance that is about equal to the width of the first light source.

* * * * *